US010907902B2

(12) United States Patent
Tokudi et al.

(10) Patent No.: US 10,907,902 B2
(45) Date of Patent: Feb. 2, 2021

(54) HEAT EXCHANGER

(71) Applicant: Hitachi-Johnson Controls Air Conditioning, Inc., Tokyo (JP)

(72) Inventors: Mikihito Tokudi, Tokyo (JP); Koji Naito, Tokyo (JP); Kazumoto Urata, Tokyo (JP); Kenji Matsumura, Tokyo (JP); Kazuhiko Tani, Tokyo (JP); Masayoshi Murofushi, Tokyo (JP); Takumi Kamiaka, Tokyo (JP)

(73) Assignee: HITACHI-JOHNSON CONTROLS AIR CONDITIONING, INC., Tokyo (JP)

( * ) Notice: Subject to any disclaimer, the term of this patent is extended or adjusted under 35 U.S.C. 154(b) by 221 days.

(21) Appl. No.: 15/758,416

(22) PCT Filed: Sep. 10, 2015

(86) PCT No.: PCT/JP2015/075752

§ 371 (c)(1),
(2) Date: Mar. 8, 2018

(87) PCT Pub. No.: WO2017/042940

PCT Pub. Date: Mar. 16, 2017

(65) Prior Publication Data

US 2018/0259265 A1 Sep. 13, 2018

(51) Int. Cl.
*F28D 1/04* (2006.01)
*F25B 39/00* (2006.01)
(Continued)

(52) U.S. Cl.
CPC ..... *F28D 1/0435* (2013.01); *F25B 39/00* (2013.01); *F28D 1/047* (2013.01); *F28D 1/0417* (2013.01);
(Continued)

(58) Field of Classification Search
CPC ..... F25B 39/00; F25B 39/04; F28D 1/0435; F28D 1/047; F28D 1/0477; F28D 1/0417;
(Continued)

(56) References Cited

U.S. PATENT DOCUMENTS 5,076,353 A * 12/1991 Haussmann ..... F25B 39/04 165/110
6,382,310 B1 5/2002 Smith
(Continued)

FOREIGN PATENT DOCUMENTS

JP 2000-304380 A 11/2000
JP 2001-066017 A 3/2001
(Continued)

OTHER PUBLICATIONS

Extended European Search Report received in corresponding European Application No. 15903602.9 dated May 15, 2019.
(Continued)

*Primary Examiner* — Devon Russell
(74) *Attorney, Agent, or Firm* — Mattingly & Malur, PC

(57) ABSTRACT

A heat exchanger includes: a gas-side port connected to piping for a gaseous refrigerant; a liquid-side port connected to piping for a liquid refrigerant; a refrigerant path that links the gas-side port to the liquid-side port; at least four heat exchange part regions that perform heat exchange between air and the refrigerant flowing through the refrigerant path; and a branching and merging part that branches and merges the refrigerant path to connect the heat exchange part regions in series between the gas-side port and the liquid-side port through the refrigerant path. The heat exchange part regions are connected to each other through the branching and merging part so as to allow the number of refrigerant paths provided in the heat exchange part region near the gas-side port to be greater than the number of refrigerant
(Continued)

paths provided in the heat exchange part region near the liquid-side port.

7 Claims, 7 Drawing Sheets

(51) Int. Cl.

| | |
|---|---|
| ***F28D 1/047*** | (2006.01) |
| ***F28F 9/26*** | (2006.01) |
| *F28D 21/00* | (2006.01) |
| *F28F 1/32* | (2006.01) |
| *F25B 39/04* | (2006.01) |

(52) U.S. Cl.
CPC ..... *F28D 1/0477* (2013.01); *F28F 9/262* (2013.01); *F25B 39/04* (2013.01); *F28D 1/0478* (2013.01); *F28D 2021/0068* (2013.01); *F28F 1/32* (2013.01); *F28F 1/325* (2013.01); *F28F 9/26* (2013.01); *F28F 9/268* (2013.01)

(58) Field of Classification Search
CPC .. F28D 1/0478; F28D 2021/0068; F28F 1/32; F28F 1/325; F28F 9/262; F28F 9/268; F28F 9/26
See application file for complete search history.

(56) References Cited

U.S. PATENT DOCUMENTS

| | | | | |
|---|---|---|---|---|
| 2010/0300141 | A1* | 12/2010 | Fujimoto | F25B 1/10 62/498 |
| 2012/0073786 | A1* | 3/2012 | Sakashita | F28D 1/0417 165/104.14 |
| 2015/0211802 | A1* | 7/2015 | Yokozeki | F28F 1/325 165/104.14 |

FOREIGN PATENT DOCUMENTS

| | | | |
|---|---|---|---|
| JP | 2007-327707 | A | 12/2007 |
| JP | 2012-237543 | A | 12/2012 |
| JP | 2015-140990 | A | 8/2015 |
| WO | 2013/084508 | A1 | 6/2013 |

OTHER PUBLICATIONS

International Search Report of PCT/JP2015/075752 dated Feb. 1, 2015.

* cited by examiner

HEAT EXCHANGER

TECHNICAL FIELD

The present invention relates to a heat exchanger.

BACKGROUND ART

In recent years, energy exhaustion issues and global warming issues have been brought to public attention, and thus it has been desired to achieve high efficiency in a refrigerating cycle of an air conditioner or refrigerator. A heat exchanger which is one of the components in the refrigerating cycle has great influence on performances of the refrigerating cycle, and thus high performance thereof is achieved.

Such a heat exchanger is configured to include a plurality of paths (flow paths for refrigerant) in order to decrease a flow path resistance. It is known that a heat transfer coefficient and pressure loss differ due to physical properties of the refrigerant between the case where the heat exchanger is used as a condenser and the case where the heat exchanger is used as an evaporator.

Because of this, in the case where the heat exchanger is used as a condenser and the case where the heat exchanger is used as an evaporator, there is the number of paths most suitable for maximizing a heat exchanging efficiency, respectively.

For example, an air conditioner described in claim 2 in Patent Literature 1 is configured such that "in a case where the heat exchanger is used as an evaporator at the time of heating, it has a branching part that branches, as seen from the upstream side in a flow direction of refrigerant, from an exit of piping of the N-th row ($N \geq 1$) into an entrance of piping of the (N+1)-th row and an entrance of piping of the (N+2)-th row, and the amount of refrigerant flowing in the piping of the (N+1)-th row is made larger than the amount of refrigerant flowing in the piping of the (N+2)-th row". That is, when used as an evaporator, the number of paths is set to be larger on the downstream side forming a domain in which gas is dominant.

This allows the air conditioner described in Patent Literature 1 to make it possible to "improve heat transfer coefficients of the heat transfer pipe for heat exchanger and the refrigerant" when the heat exchanger in the outdoor machine is used as a condenser during cooling operation or the like. Moreover, the air conditioner makes it possible to "avoid malfunction due to frost formation" when the heat exchanger in the outdoor machine is used as an evaporator during heating operation or the like (see paragraphs [0026]-[0027] in Patent Literature 1).

Moreover, a heat exchanger for refrigerator described in the abstract in Patent Literature 2 is configured such that "the heat exchanger composed of a plurality of rows of heat exchangers allows the number of refrigerant paths 19, 20, 21, 22 communicating the heat exchangers 16, 17, 18 with each other to be made smaller as the refrigerant goes toward the outlet side 12b of the gas cooler 12 from the inlet side 12a, and the number of outlets and inlets of the refrigerant paths of the heat exchangers 16, 17, 18 is changed".

This allows the heat exchanger for refrigerator described in Patent Literature 2 to make it possible to "maintain the refrigerant flowing through each heat exchanger at the flow velocity suitable for heat exchange, depending on an increase in refrigerant density associated with the temperature level of the refrigerant, thereby enhancing a heat exchanging efficiency" (see paragraph [0033] in Patent Literature 2).

CITATION LIST

Patent Literature

Patent Literature 1: Japanese Unexamined Patent Application Publication No. 2007-327707

Patent Literature 2: Japanese Unexamined Patent Application Publication No. 2000-304380

SUMMARY OF THE INVENTION

Technical Problem

The air conditioner described in Patent Literature 1 allows the branching and merging parts to be provided in the refrigerant paths in the heat exchanger and allows the number of refrigerant paths to be changed as described above, between the domain in which gas is dominant, and the domain in which liquid is dominant, thereby improving a heat exchanging efficiency of the heat exchanger.

Incidentally, the air conditioner described in Patent Literature 1 allows the number of times of merging to be one time (see FIG. 4 in Patent Literature 1). Because of this, when the heat exchanger functions, for example, as a condenser at the time of low load, there has been room for further improvement as to fully increasing the flow velocity of refrigerant in the domain in which the liquid phase refrigerant is dominant, to enhance a heat exchanging efficiency of the heat exchanger.

While on the other hand, the heat exchanger for refrigerator described in Patent Literature 2 allows the branching and merging part to be provided twice (see FIG. 1 in Patent Literature 2). Because of this, when the heat exchanger is used as a condenser, the flow velocity of refrigerant can be secured even at the time of low load in the domain in which the liquid phase refrigerant is dominant.

However, since the branching and merging parts are provided at boundary parts between each row of the fin plates of the heat exchanger, the number of rows of fin plates of the heat exchanger needs to be set to three or more in order to carry out the merging twice. This has caused a problem in that an installation space of the heat exchanger is enlarged.

Moreover, the respective branching and merging parts are located at the upper end or lower end of the heat transfer pipe which is communicated with the next refrigerant path after the merging. Consequently, in the respective branching and merging parts, distances of respective refrigerant paths, taken until flowing into the branching and merging parts, that is, refrigerant flow path lengths do not become equal to each other. Accordingly, the three-forked shape of the branching and merging part becomes asymmetrical (see FIG. 1 in Patent Literature 2).

Moreover, due to the three-forked shape of the branching and merging part being asymmetrical, the refrigerant is not equally distributed at the branching and merging part to allow the refrigerant to generate deflected flow in the refrigerant path on one side. Furthermore, the branching and merging part includes a large number of bend sections and thus is complicated in shape, leading to an increase in production cost of the branching and merging part. In addition, since the branching and merging part is provided twice, demerits such as deflected flow of the refrigerant and an increase in cost become more remarkable.

The present invention has therefore been made in view of the above problems, and it is an object of the present invention to provide a heat exchanger capable of improving performances when functioning as a condenser and as an evaporator.

Solution to Problem

In order to solve the above problems, the present invention provides, as one aspect thereof, a heat exchanger of fin-plate type used in an outdoor unit or indoor unit of an air conditioner, including: a gas-side port connected to piping through which a gaseous refrigerant flows; a liquid-side port connected to piping through which a liquid refrigerant flows; a refrigerant path that links the gas-side port to the liquid-side port; at least four heat exchange part regions that perform heat exchange between air and the refrigerant flowing through the refrigerant path; and a branching and merging part that branches and merges the refrigerant path to connect the heat exchange part regions in series between the gas-side port and the liquid-side port through the refrigerant path, wherein the heat exchange part regions are connected to each other through the branching and merging part so as to allow the number of refrigerant paths provided in the heat exchange part region near the gas-side port to be greater than the number of refrigerant paths provided in the heat exchange part region near the liquid-side port.

Advantageous Effects of the Invention

The present invention makes it possible to provide a heat exchanger capable of improving performances when functioning as a condenser and as an evaporator.

DESCRIPTION OF EMBODIMENTS

Hereinafter, a heat exchanger according to one embodiment of the present invention will be described in detail.

Note that description is given below, as an example, of a case where the heat exchanger according to one embodiment is provided in an air conditioner. However, the heat exchanger according to one embodiment of the present invention is not particularly limited to the above example, and can be applied to every cooling and heating device provided with a refrigerating cycle other than the air conditioner.

Moreover, so long as there is no particular remark in the description below, a refrigerant or refrigerating cycle means a refrigerant or refrigerating cycle that can be used in cooling or heating, or in both of cooling and heating.

Furthermore, for convenience of explanation, the common member in each of the drawings is given the same reference sign and thus repetitive description thereof is omitted. As for directional axes with respect to front, behind, upper, lower, right, left, one end, the other end, and the like, they depend on description in each figure.

Here, an air conditioner 100 including the heat exchanger according to one embodiment of the present invention is adapted to allow an outdoor machine 100A and an indoor machine 1008 to be connected through refrigerant pipings 100V, 100L or the like, and to circulate refrigerant in the circuit to thereby enable indoor air-conditioning.

First Embodiment

Figure 1:
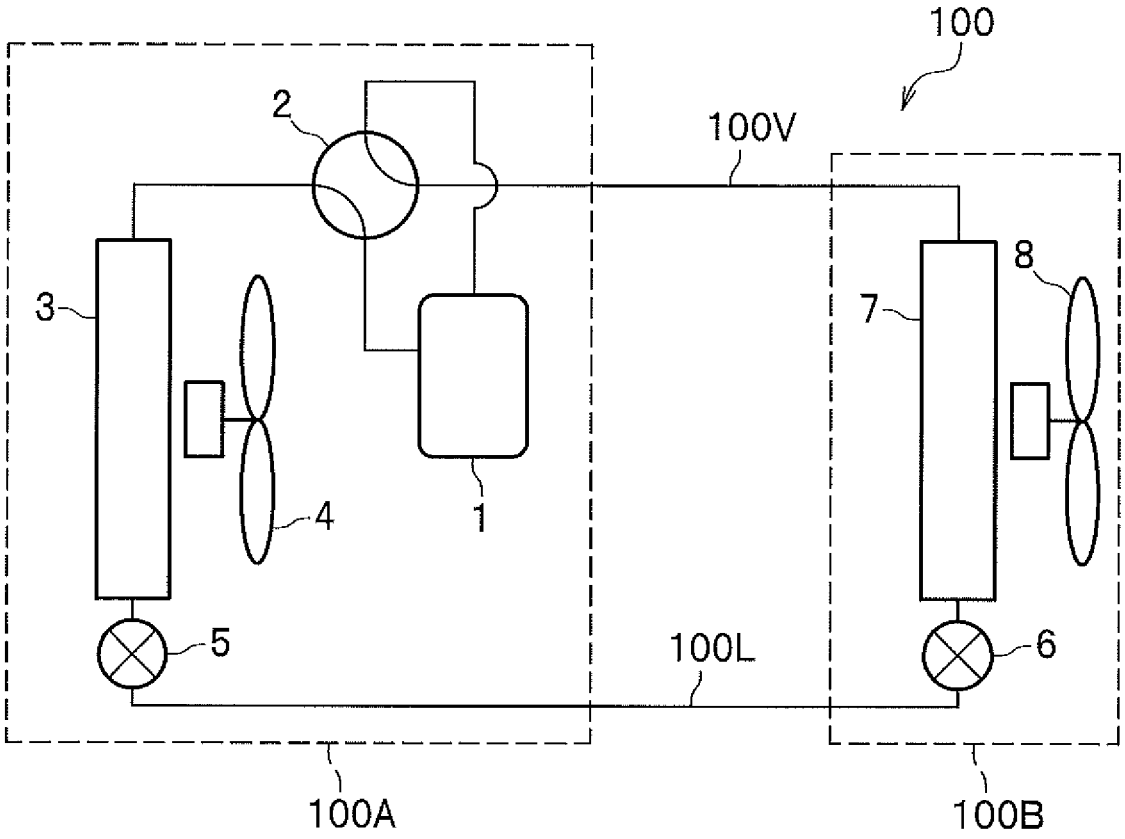
FIG. 1 is a diagram for explaining a refrigerating cycle of an air conditioner including a heat exchanger according to a first embodiment.

FIG. 1 is a diagram for explaining a refrigerating cycle of the air conditioner 100 including a heat exchanger 3 according to a first embodiment.

As shown in FIG. 1, the air conditioner 100 according to the first embodiment includes the outdoor machine 100A, the indoor machine 100B, and the refrigerant pipings 100L, 100V that connect the outdoor machine 100A and the indoor machine 100B with each other.

The outdoor machine 100A (outdoor unit) includes a compressor 1, a four-way valve 2 that serves a function of switching a flow path direction of refrigerant between during cooling operation and during heating operation, and a cross fin tube type outdoor heat exchanger 3 (details will be described below). The outdoor machine 100A also includes a blower 4 that feeds air into the heat exchanger 3, and an expansion valve 5 that serves as a decompression device on the outdoor machine 100A side.

Moreover, the indoor machine 100B (indoor unit) includes an expansion valve 6 that serves as a decompression device on the indoor machine 100B side, a cross fin tube type indoor heat exchanger 7, and a blower 8 that feeds air into the heat exchanger 7.

Note that in FIG. 1, a connecting direction of the flow path in the four-way valve 2 shows a state during cooling operation, and illustration of a state during heating operation is omitted. Moreover, the numbers of the outdoor machine 100A and the indoor machine 100B are not particularly limited to one, respectively, and a plurality of outdoor machines and indoor machines may be provided.

The refrigerant piping 100L allows a liquid refrigerant of nearly liquid phase to flow through the inside thereof. Moreover, the refrigerant piping 100V allows a gaseous refrigerant of nearly vapor phase to flow through the inside thereof.

Moreover, when the four-way valve 2 is switched to change the heating and cooling operating states, the heat exchanger 3 of the outdoor machine 100A and the heat exchanger 7 of the indoor machine 100B switch between functions as a condenser and as an evaporator.

Concretely, when the four-way valve 2 is in a state during cooling operation shown in FIG. 1, the heat exchanger 3 functions as a condenser and allows the gaseous refrigerant to radiate heat to be condensed into the liquid refrigerant. On the other hand, the heat exchanger 7 functions as an evaporator and allows cold of the liquid refrigerant to radiate heat to be evaporated into the gaseous refrigerant.

Moreover, when the four-way valve 2 is in a state (not shown) during heating operation, the heat exchanger 3 functions as an evaporator and allows cold of the liquid refrigerant to radiate heat to be evaporated into the gaseous refrigerant. On the other hand, the heat exchanger 7 functions as a condenser and allows the gaseous refrigerant to radiate heat to be condensed into the liquid refrigerant.

Next, with reference to FIG. 2, description will be given of a graph showing a relationship between the number of refrigerant paths in a heat exchanger 3A according to the first embodiment and an energy consumption efficiency COP of the air conditioner 100. The horizontal axis indicates the total number of refrigerant paths in the heat exchanger 3, and the vertical axis indicates the energy consumption efficiency COP of the air conditioner 100. Although description is given below, taking the heat exchanger 3-3A provided in the outdoor machine 100A as an example, the heat exchanger according to each of embodiments of the present invention can also be applied to the heat exchanger 7 in the indoor machine 100B.

Note that in the description below, the refrigerant path means, in the heat exchanger 3 including a plurality of rows of fin plates 11A, 11B, . . . (also see FIG. 3 to be described below), a refrigerant flow path that communicates each row of fin plates 11A, 11B, . . . with each other. Moreover, the number of paths means the number of independent refrigerant flow paths, namely, the number of independent refrigerant paths each communicating each row of fin plates 11A, 11B, . . . with each other in the heat exchanger 3. That is, N paths (N is a natural number) mean that N independent communicating paths are provided in each row of fin plates 11A, 11B, . . . . Moreover, path arrangement means the state of arrangement of the refrigerant paths in the entire heat exchanger 3.

As described above, for example, the air conditioner 100 exclusive for cooling provided with a refrigerating cycle and the air conditioner 100 exclusive for heating of a heat pump type are different from each other in that the outdoor and indoor heat exchangers 3, 7 each function as a condenser or function as an evaporator during cooling operation and during heating operation.

In recent years, it is known that, particularly in the case where the heat exchanger 3 in the outdoor machine 100A functions as a condenser at the time of low load, performance improvement such as a heat exchanging efficiency and energy consumption efficiency COP greatly contributes to energy saving throughout the year.

Figure 2:
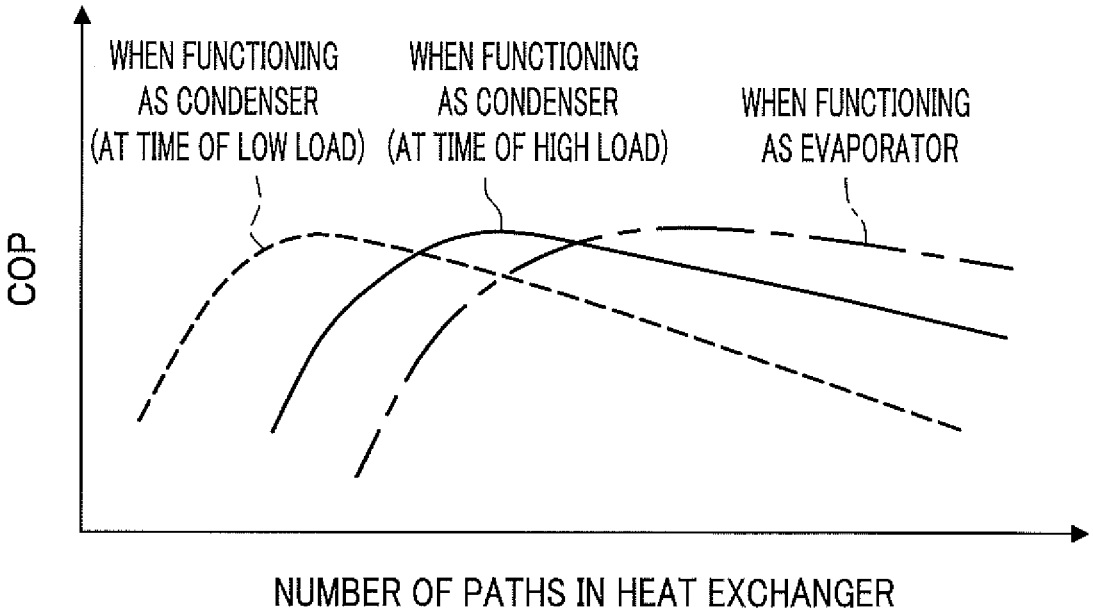
FIG. 2 is a graph for explaining a relationship between the number of refrigerant paths in the heat exchanger according to the first embodiment and an energy consumption efficiency COP of the air conditioner.

In order to aim at actualization of energy saving throughout the year and to efficiently use the heat exchanger 3, it is generally desirable for the number of refrigerant paths in the heat exchanger 3, taking the graph shown in FIG. 2 into consideration, to consider the number of refrigerant paths suitable for maximizing the energy consumption efficiency COP in the case where the heat exchanger 3 functions as a condenser at the time of high load (a solid line in FIG. 2), and in the case where the heat exchanger 3 functions as an evaporator (a dashed line in FIG. 2). Moreover, it is desirable to consider the number of refrigerant paths suitable for maximizing the energy consumption efficiency COP in the case where the heat exchanger 3 functions as a condenser at the time of high load (a broken line in FIG. 2).

Here, a heat transfer pipe used in the refrigerant flow path in the heat exchanger 3 generally has the shape of a thin tubular pipe. Moreover, the respective refrigerant paths are configured to communicate the internal fin plates 11A, 11B, . . . composing the heat exchanger 3 with each other (also see FIG. 3). Further, when the heat exchanger 3 functions, for example, as an evaporator, the number of paths is made large for the purpose of decreasing a flow velocity of the refrigerant to reduce a flow resistance, and when functioning as a condenser, the number of paths is made small for the purpose of increasing the flow velocity of the refrigerant to secure refrigerant flow.

More specifically, when the heat exchanger 3 functions as a condenser, a density of the refrigerant becomes high as compared to the case where the heat exchanger 3 functions as an evaporator. Consequently, the flow velocity of the refrigerant becomes low (a pressure loss is reduced at this time). Moreover, at the time of low load, the amount of refrigerant flowing through the condenser becomes smaller than at the time of high load. In other words, it is desirable to set the number of refrigerant paths to be smaller than that at the time of high load in order to increase the flow velocity of the refrigerant with small flow and high density to increase a heat exchanging efficiency of the heat exchanger 3.

While on the other hand, when the heat exchanger 3 functions as an evaporator, the density of the refrigerant becomes low as compared to the case where the heat exchanger 3 functions as a condenser. Consequently, the flow velocity of the refrigerant becomes high (the pressure loss becomes increased at this time). Therefore, it is desirable to make the number of refrigerant paths larger than that in the case where the heat exchanger 3 functions as a condenser, in order to decrease the flow velocity of the refrigerant to reduce the pressure loss and to increase the heat exchanging efficiency of the heat exchanger 3. When thus configured, the heat exchanging efficiency of the heat exchanger 3 can be maximized.

Note that the compressor 1 cannot keep predetermined discharge when the pressure loss in the heat exchanger 3 becomes increased. Therefore, when the heat exchanger 3 functions as an evaporator, the number of refrigerant paths is made large to decrease the flow velocity of the refrigerant, thereby making it possible to keep discharging capability of the compressor 1.

Summarizing the above, when the heat exchanger 3 functions as a condenser, it is desirable to set the number of refrigerant paths to be smaller than that in the case where the heat exchanger 3 functions as an evaporator, in order to increase the flow velocity of the refrigerant flowing in the heat transfer pipes. At this time, the efficiency of the heat exchanger 3 becomes the maximum and thus the energy consumption efficiency COP of the air conditioner 100 also becomes the maximum (see the broken line in FIG. 2).

Moreover, when the heat exchanger 3 functions as an evaporator, it is desirable to set the number of refrigerant paths to be larger than that in the case where the heat exchanger 3 functions as a condenser, in order to decrease the flow velocity of the refrigerant flowing in the heat transfer pipes. At this time, the efficiency of the heat exchanger 3 becomes the maximum and thus the energy consumption efficiency COP of the air conditioner 100 also becomes the maximum (see the dashed line in FIG. 2).

Next, with reference to a schematic diagram shown in FIG. 3, description will be given of a state of the refrigerant paths in the heat exchanger 3A according to the first embodiment.

The heat exchanger 3A is, for example, a cross fin tube type heat exchanger 3, and includes fin plates 11A, 11B each having a plurality of aluminum fins 10 arranged in a thickness direction thereof, and a refrigerant piping 20.

Note that reference sign 20 generically names every heat transfer pipe to be described below. Moreover, the refrigerant piping 20 visible on the surface side of the paper in FIG. 3 (on the left side in FIG. 3) is depicted in the shape of a thick pipe, and the refrigerant piping 20 invisible and located on the back side of the paper (on the right side in FIG. 3) is depicted by a broken line.

Figure 3:
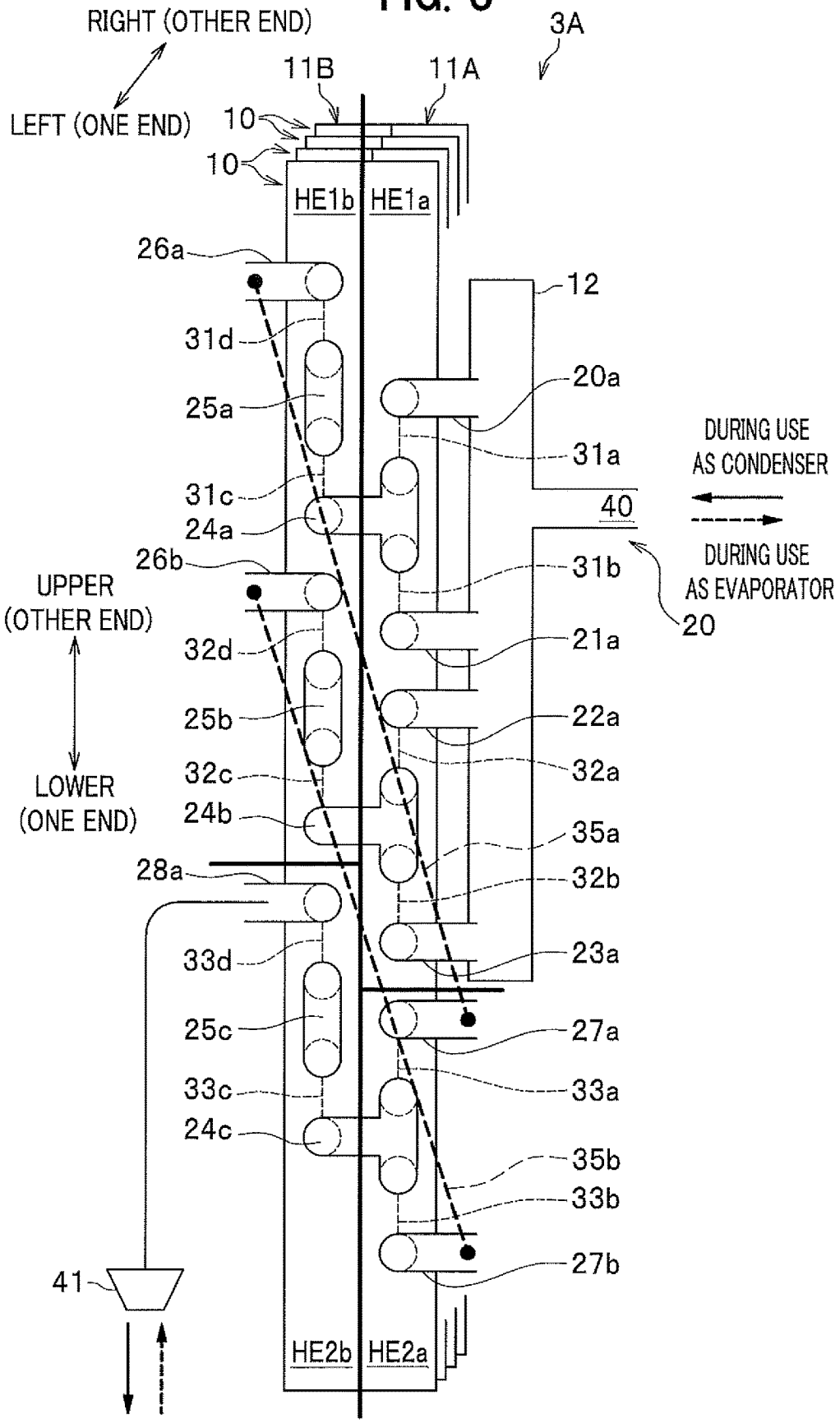
FIG. 3 is a schematic diagram for explaining a state of the refrigerant paths in the heat exchanger according to the first embodiment.

As described above, the refrigerant piping 20 composes a flow path through which the refrigerant flows, and has a form such that it penetrates the fins 10 (each of the fin plates 11A, 11B) in a direction to the back of the paper in FIG. 3, i.e., in the right-left direction in FIG. 3. That is, the refrigerant piping 20 extends in a nearly horizontal direction (a direction orthogonal to a vertical direction: the right-left direction in FIG. 3). Moreover, the refrigerant piping 20 has a form such that it passes through return bends 31*a*~33*c* each of which is a nearly U-shaped communication flow path and reverses a flow path direction, respectively, and extends again in the nearly horizontal direction (the direction orthogonal to the vertical direction: the right-left direction in FIG. 3). Summarizing the above, the refrigerant piping 20 is disposed so as to meander or reciprocate in a U-shaped form in the fin plates 11A, 11B.

Moreover, the refrigerant piping 20 is provided with a header 12 to which at least four heat transfer pipes 20*a*, 21*a*, 22*a*, 23*a* are connected, and connected to one end of the fin plate 11A (the left end in FIG. 3). Note that, when the heat exchanger 3A functions as a condenser, the header 12 functions as a distributing member, and when the heat exchanger 3A functions as an evaporator, the header 12 functions as a merging member.

The heat transfer pipe 20*a* extends from the header 12 to the fin plate 11A and penetrates the fin plate 11A from one end side to the other end side in the right-left direction in FIG. 3 (in the direction from the surface to the back of the paper in FIG. 3). Moreover, the heat transfer pipe 20*a* is connected to the other end side of the return bend 31*a* with a lower side of the return bend 31*a* being defined as one end side, i.e., to an upper side of the return bend 31*a*. The heat transfer pipe 21*a* extends from the header 12 to the fin plate 11A and penetrates the fin plate 11A from one end side to the other end side in the right-left direction in FIG. 3 (in the direction from the surface to the back of the paper in FIG. 3), and is further connected to one end side of the return bend 31*b*, i.e., to a lower side of the return bend 31*b*.

A branching and merging part 24*a* is, for example, three-forked and disposed between the heat transfer pipe 20*a* and the heat transfer pipe 21*a*. Moreover, two sections among the three-forked sections penetrate the fin plate 11A, respectively, from one end side to the other end side in the right-left direction in FIG. 3 (in the direction from the surface to the back of the paper in FIG. 3). Further, the two sections are connected to one end side of the return bend 31*a* and the other end side of the return bend 31*b*, respectively, on the right side in FIG. 3, i.e., on the back side of the paper in FIG. 3. Moreover, the branching and merging part 24*a* allows the remaining one section among the three-forked sections to penetrate the fin plate 11B from one end side to the other end side in the right-left direction in FIG. 3 (in the direction from the surface to the back of the paper in FIG. 3). Further, the one section is connected to one end side of the return bend 31*c* on the right side in FIG. 3, i.e., on the back side of the paper in FIG. 3.

A heat transfer pipe 25*a* has a nearly U-shape, and in a side view of FIG. 3, two heat transfer pipes located at the lower side (one end side) and the upper side (other end side) penetrate the fin plate 11B, respectively, from one end side to the other end side in the right-left direction in FIG. 3 (in the direction from the surface to the back of the paper in FIG. 3). Moreover, the heat transfer pipe 25*a* allows one end side thereof to be connected to the return bend 31*c* and the other end side thereof to be connected to a return bend 31*d*, on the right side in FIG. 3, i.e., on the back side of the paper in FIG. 3.

A heat transfer pipe 26*a* penetrates the fin plate 11B from one end side to the other end side in the right-left direction in FIG. 3 (in the direction from the surface to the back of the paper in FIG. 3), and is connected to the other end side of the return bend 31*d* on the right side in FIG. 3, i.e., on the back side of the paper in FIG. 3.

Moreover, the heat transfer pipe 22*a* penetrates the fin plate 11A from one end side to the other end side in the right-left direction in FIG. 3 (in the direction from the surface to the back of the paper in FIG. 3), and is connected to the other end side of the return bend 32*a* on the right side in FIG. 3, i.e., on the back side of the paper in FIG. 3.

Moreover, the heat transfer pipe 23*a* penetrates the fin plate 11A from one end side to the other end side in the right-left direction in FIG. 3 (in the direction from the surface to the back of the paper in FIG. 3), and is connected to one end side of the return bend 32*b* on the right side in FIG. 3, i.e., on the back side of the paper in FIG. 3.

A branching and merging part 24*b* is, for example, three-forked and located between the heat transfer pipe 22*a* and the heat transfer pipe 23*a*, and two sections among the three-forked sections penetrate the fin plate 11A from one end side to the other end side to be connected to one end side of the return bend 32*a* and the other end side of the return bend 32*b*, respectively. Moreover, the branching and merging part 24*b* allows the remaining one section to penetrate the fin plate 11B from one end side to the other end side to be connected to one end side of the return bend 32*c*.

A heat transfer pipe 25*b* has a nearly U-shape, and in a side view of FIG. 3, two heat transfer pipes located at the lower side (one end side) and the upper side (other end side) penetrate the fin plate 11B, respectively, from one end side to the other end side in the right-left direction in FIG. 3 (in the direction from the surface to the back of the paper in FIG. 3). Moreover, the heat transfer pipe 25*b* allows one end side thereof to be connected to the return bend 32*c* and the other end side thereof to be connected to a return bend 32*d*, on the right side in FIG. 3, i.e., on the back side of the paper in FIG. 3.

A heat transfer pipe 27*a* is located below the heat transfer pipe 23*a* and penetrates the fin plate 11A from one end side to the other end side to be connected to the other end side of the return bend 33*a*. Moreover, a heat transfer pipe 27*b* is located below the heat transfer pipe 27*a* and penetrates the fin plate 11A from one end side to the other end side to be connected to one end side of the return bend 33*b*.

A branching and merging part 24*c* is, for example, three-forked and located between the heat transfer pipe 27*a* and the heat transfer pipe 27*b*, and two sections among the three-forked sections penetrate the fin plate 11A from one end side to the other end side to be connected to one end side of the return bend 33*a* and the other end side of the return bend 33*b*, respectively. Moreover, the branching and merging part 24*c* allows the remaining one section to penetrate the fin plate 11B from one end side to the other end side to be connected to one end side of the return bend 33*c*.

A heat transfer pipe 25*c* has a nearly U-shape, and in a side view of FIG. 3, two heat transfer pipes located at the lower side (one end side) and the upper side (other end side) penetrate the fin plate 11B, respectively, from one end side to the other end side in the right-left direction in FIG. 3 (in the direction from the surface to the back of the paper in FIG. 3). Moreover, the heat transfer pipe 25*c* allows one end side thereof to be connected to the return bend 33*c* and the other end side thereof to be connected to a return bend 33*d*, on the right side in FIG. 3, i.e., on the back side of the paper in FIG. 3.

Moreover, the heat transfer pipes 26*a* and 27*a* are connected to each other through a connection pipe 35*a* (see FIG. 3). Further, the heat transfer pipes 26*b* and 27*b* are connected to each other through a connection pipe 35*b*.

Note that, as described above, the refrigerant path in the heat exchanger 3 according to each of embodiments of the present invention means, in the heat exchanger 3 including a plurality of rows of fin plates 11A, 11B, . . . , a path (passage) that communicates each row of fin plates 11A, 11B, . . . with each other.

Moreover, the number of refrigerant paths in the present embodiment means the number of independent refrigerant paths. That is, the number of refrigerant paths in the present embodiment corresponds to the number of flow paths that are communicated with rows of fin plates 11A, 11B, . . . such that one end is different from the other end in the refrigerant piping 20. More specifically, the number of refrigerant paths corresponds to the number of flow paths that communicate each row of fin plates 11A, 11B, . . . with each other through flow paths including any of the heat transfer pipes 20*a*~23*a*, the branching and merging parts 24*a*~24*c*, or the connection pipes 35*a*, 35*b*. That is, when the number of refrigerant paths is counted in the present embodiment, for convenience explanation, the number of the heat transfer pipes 20*a*~23*a*, the branching and merging parts 24*a*~24*c*, or the connection pipes 35*a*, 35*b* should be counted.

In the above configuration, for example, refrigerant which flows through a gate 40 into the header 12 of the heat exchanger 3A that functions as a condenser, is eventually merged into one path from N paths (N is a natural number) in the process of flowing through the refrigerant path of the refrigerant piping 20, and flows through a gate 41 into the expansion valve 5 (see FIG. 1).

Moreover, conversely in the same way, for example, refrigerant which flows through the gate 41 into a heat transfer pipe 28*a* of the heat exchanger 3A that functions as an evaporator, is eventually branched into N paths (N is a natural number) from one path in the process of flowing through the refrigerant path of the refrigerant piping 20, and flows through the gate 40 into the four-way valve 2 (see FIG. 1).

Further, with reference to the schematic diagram shown in FIG. 3, description will be given of characteristics of the heat exchanger 3A according to the first embodiment of the present invention.

As indicated by a thick solid line in FIG. 3, the heat exchanger 3A is provided with four heat exchange part regions sectioned into each row, and upper and lower parts, of the fin plates 11A, 11B, which are composed of a first upper heat exchange part region HE1*a* and a second upper heat exchange part region HE1*b*, and a first lower heat exchange part region HE2*a* and a second lower heat exchange part region HE2*b*.

In other words, the plurality of rows of fin plates 11A, 11B includes at least four heat exchange part regions HE1*a*~HE2*b*.

Among these regions, the first upper heat exchange part region HE1*a* is, in the fin plate 11A, a heat exchange part region on the upper side where the heat transfer pipes 20*a*~23*a* communicated with the header 12 are disposed.

Moreover, the first lower heat exchange part region HE2*a* is, in the fin plate 11A, a region on the lower side than the heat transfer pipe 23*a* that is communicated with the header 12 and disposed at the lowermost position, namely, a heat exchange part region on the lower side including the heat transfer pipe 27*a* to which the connection pipe 35*a* is connected.

Similarly, the second upper heat exchange part region HE1*b* is, in the fin plate 11B, a heat exchange part region on the upper side including the position at which the branching and merging part 24*b* disposed at the lowermost position among the branching and merging parts 24*a*, 24*b* in the first round is disposed. Namely, the second upper heat exchange part region HE1*b* is, in the fin plate 11B, a heat exchange part region on the upper side than the position at which the heat transfer pipe 28*a* after having passed through the branching and merging part 24*c* in the second round is disposed.

Moreover, the second lower heat exchange part region HE2*b* is, in the fin plate 11B, a heat exchange part region on the lower side than the branching and merging part 24*b* that is disposed at the lowermost position among the branching and merging parts 24*a*, 24*b* in the first round. Namely, the second lower heat exchange part region HE2*b* is, in the fin plate 11B, a heat exchange part region on the lower side including the heat transfer pipe 28*a* after having passed through the branching and merging part 24*c* in the second round.

The heat exchanger 3A allows the branching and merging parts 24*a*, 24*b* to be disposed, among the four sectioned heat exchange part regions HE1*a*~HE2*b*, at places where the refrigerant flows out of the first upper heat exchange part region HE1*a* and the refrigerant flows into the second upper heat exchange part region HE1*b*. That is, the heat exchanger 3A is provided with the branching and merging parts 24*a*, 24*b* at the upstream side of the connection pipes 35*a*, 35*b*.

Moreover, the heat exchanger 3A allows the branching and merging part 24*c* to be disposed at a place where the refrigerant flows out of the first lower heat exchange part region HE2*a* and the refrigerant flows into the second lower heat exchange part region HE2*b*. That is, the heat exchanger 3A is provided with the branching and merging part 24*c* at the downstream side of the connection pipes 35*a*, 35*b*.

Furthermore, the heat exchanger 3A allows the connection pipes 35*a*, 35*b* to be disposed at places where the refrigerant flows out of the second upper heat exchange part region HE1*b* and the refrigerant flows into the first lower heat exchange part region HE2*a*.

In other words, the heat exchanger 3A has a flow path passing through the branching and merging parts 24*a*~24*c* and a flow path not passing through the branching and merging parts 24*a*~24*c* when the refrigerant flows out of one of the heat exchange part regions HE1*a*~HE2*b* into another of the heat exchange part regions HE1*a*~HE2*b*. Note that the flow path not passing through the branching and merging parts 24*a*~24*c* means, specifically, a flow path passing through the connection pipes 35*a*, 35*b*.

Providing the branching and merging parts 24*a*, 24*b*, 24*c* and the connection pipes 35*a*, 35*b* in this way makes it possible for the heat exchanger 3A according to the present embodiment to change the number of paths of the refrigerant piping 20 at a boundary between each row, and at a boundary between the upper and lower parts, of the fin plates 11A and 11B.

More specifically, the path arrangement in the heat exchanger 3A has, for example, when functioning as a condenser, four paths of the heat transfer pipes 20*a*~23*a* at the inlet side of the first upper heat exchange part region HE1*a*. The path arrangement further has two paths of the branching and merging parts 24*a*, 24*b* at the boundaries between the fin plates 11A and 11B in an upper heat exchange part region HE1 located at the upstream side of the connection pipes 35*a*, 35*b*. The path arrangement further has two paths of the connection pipes 35*a*, 35*b* at the boundaries between the fin plates 11A and 11B. The path arrangement further has one path of the branching and merging part 24*c* at the boundary between the fin plates 11A and 11B in a lower heat exchange part region HE2 located at the downstream side of the connection pipes 35*a*, 35*b*. The path arrangement further has one path at the outlet side of the second lower heat exchange part region HE2*b* to the gate 41. Thus, the path arrangement is set to gradually decrease the number of paths with a change of four paths→ two paths→ two paths→ one path→ one path, from the inlet side to the outlet side.

Restating the above, the heat exchanger 3A according to the present embodiment is the heat exchanger 3, 7 of fin-plate type 11A, 11B, . . . used in the outdoor unit 100A, or the indoor unit 100B, of the air conditioner 100. The heat exchanger 3A includes the gas-side port (gate 40) connected to the piping through which the gaseous refrigerant flows, the liquid-side port (gate 41) connected to the piping through which the liquid refrigerant flows, and the refrigerant path that links the gas-side port to the liquid-side port. The heat exchanger 3A further includes at least four heat exchange part regions HE1*a*~HE2*b* that perform heat exchange between air and the refrigerant flowing through the refrigerant path, and the branching and merging part 24 (24*a*~24*c*) that branches and merges the refrigerant path to connect the heat exchange part regions HE1*a*~HE2*b* in series between the gas-side port (gate 40) and the liquid-side port (gate 41) through the refrigerant path.

Moreover, the heat exchange part regions HE1*a*~HE2*b* are connected to each other through the branching and merging part 24 so as to allow the number of refrigerant paths (heat transfer pipes 20*a*~23*a*) provided in the heat exchange part region HE1*a* nearest the gas-side port (gate 40) to be greater than the number of refrigerant paths (heat transfer pipe 28*a*) provided in the heat exchange part region HE2*b* nearest the liquid-side port (gate 41).

Moreover, the heat exchange part region HE1*a* nearest the gas-side port (gate 40) is provided above the heat exchange part region HE2*b* nearest the liquid-side port (gate 41).

Furthermore, in the case where the heat exchanger 3A functions as a condenser, the branching and merging parts 24*a*~24*c* are provided to allow the number of refrigerant paths to be decreased when the refrigerant flows out of one heat exchange part region HE1*a* into another heat exchange part region HE1*b* among the heat exchange part regions HE1*a*~HE2*b*.

Moreover, the refrigerant to flow through the refrigerant piping 20 in the heat exchanger 3A flows in through one heat exchange part region HE1*a* in the upper heat exchange part region HE1, then flows through another adjacent heat exchange part region HE1*b* in the upper heat exchange part region HE1, then flows through the connection pipes 35*a*, 35*b* into one heat exchange part region HE2*a* in the lower heat exchange part region HE2, then flows through another adjacent heat exchange part region HE2*b* in the lower heat exchange part region HE2, and flows out.

Note that the same thing as the case of the condenser described above applies to the case where the heat exchanger 3A functions as an evaporator, too. In this case, the heat exchanger 3A is provided with the branching and merging parts 24*a*~24*c* so as to allow the number of refrigerant paths to be increased when the refrigerant flows out of one heat exchange part region HE1*a* of the heat exchange part regions HE1*a*~HE2*b* into the other heat exchange part region HE1*b*.

Incidentally, refrigerant generally causes phase transition between gas phase and liquid phase inside the heat exchanger 3A. Since a gas phase refrigerant has a low density even with the same mass flow rate as compared to a liquid phase refrigerant, the flow velocity of the gas phase refrigerant becomes high approximately ten times or more as compared to the flow velocity of the liquid phase refrigerant.

As a result, the pressure loss is increased due to increase in the flow velocity in a domain in which the gas phase refrigerant is dominant, thereby becoming easy to cause lowering of the heat exchanging efficiency. Moreover, the heat transfer coefficient is lowered due to decrease in the flow velocity in a domain in which the liquid phase refrigerant is dominant, thereby becoming easy to cause lowering of the heat exchanging efficiency.

Therefore, when the heat exchanger 3A functions as a condenser, the path arrangement is set to irregularly and gradually decrease the number of paths as described above, thereby making it possible, in the domain in which the gas phase refrigerant is dominant, to increase the number of paths to decrease the flow velocity and thus to prevent increase in the pressure loss.

Moreover, in the domain in which the liquid phase refrigerant is dominant, the number of paths is decreased from four paths at the inlet side to one path at the outlet side, i.e., the number of paths is decreased to one quarter, thereby making it possible to increase the flow velocity and thus to achieve improvement in the heat transfer coefficient.

Further, when the heat exchanger 3A functions as an evaporator, the number of paths can be increased from one path at the inlet side during use as an evaporator (the outlet side during use as a condenser) to four paths at the outlet side during use as an evaporator (the inlet side during use as a condenser), i.e., by a factor of four. This makes it possible to prevent the pressure loss from being increased in the domain in which the gas phase refrigerant is dominant.

Incidentally, as a comparative example, for example, the heat exchanger described in Patent Literature 2 allows the branching and merging parts to be provided at places where the heat transfer pipe changes to the respective fin plates of the heat exchanger 16 to the heat exchanger 18, respectively. Because of this, for example, in order to carry out the branching and merging twice, the number of rows of the heat exchanger needs to be set to three or more. This causes a problem in that an installation space of the heat exchanger is enlarged.

Contrary to this, the heat exchanger 3A according to the present embodiment allows the connection pipes 35*a*, 35*b* to be connected diagonally in the vertical direction, thereby making it possible to arrange the branching and merging parts 24*a*~24*c* in the upper heat exchange part region HE1 and the lower heat exchange part region HE2, respectively.

This makes it possible, even where the number of rows of the heat exchanger 3A is two, to allow the branching and merging to be carried out twice. In this way, space-saving of an installation space of the heat exchanger 3A can be realized.

Moreover, in the heat exchanger 3A according to the present embodiment, consideration will be given to the case where the heat exchanger 3A functions as a condenser. In this case, a percentage in the vertical direction of the heat exchanger 3A, of the heat transfer pipes 20*a*~23*a* composing the paths of refrigerant flowing into the branching and merging parts 24*a*, 24*b* in the first round can be made higher than a percentage in the vertical direction of the heat transfer pipe 28*a* composing the path of refrigerant flowing out of the branching and merging part 24*c* in the second round. That is, when "a length in the vertical direction of the fin plate 11A is equal to (=) a length in the vertical direction of the fin plate 11B", "a length in the vertical direction of the first upper heat exchange part region HE1*a* is longer than (>) a length in the vertical direction of the second lower heat exchange part region HE2*b*".

Further in other words, the heat exchange part regions HE1*a*~HE2*b* are sectioned into at least the upper heat exchange part region HE1 and the lower heat exchange part region HE2, and the length in the vertical direction of the upper heat exchange part region HE1 is longer than the length in the vertical direction of the lower heat exchange part region HE2.

This makes it possible to further increase the number of paths in the domain in which the gas phase refrigerant flowing into the branching and merging parts 24*a*, 24*b* in the first round is dominant. That is, the number of heat transfer pipes 20*a*~23*a* can be easily increased to four or more. When thus arranged, the pressure loss can be decreased in the case where the heat exchanger 3A functions especially as an evaporator.

Figure 4:
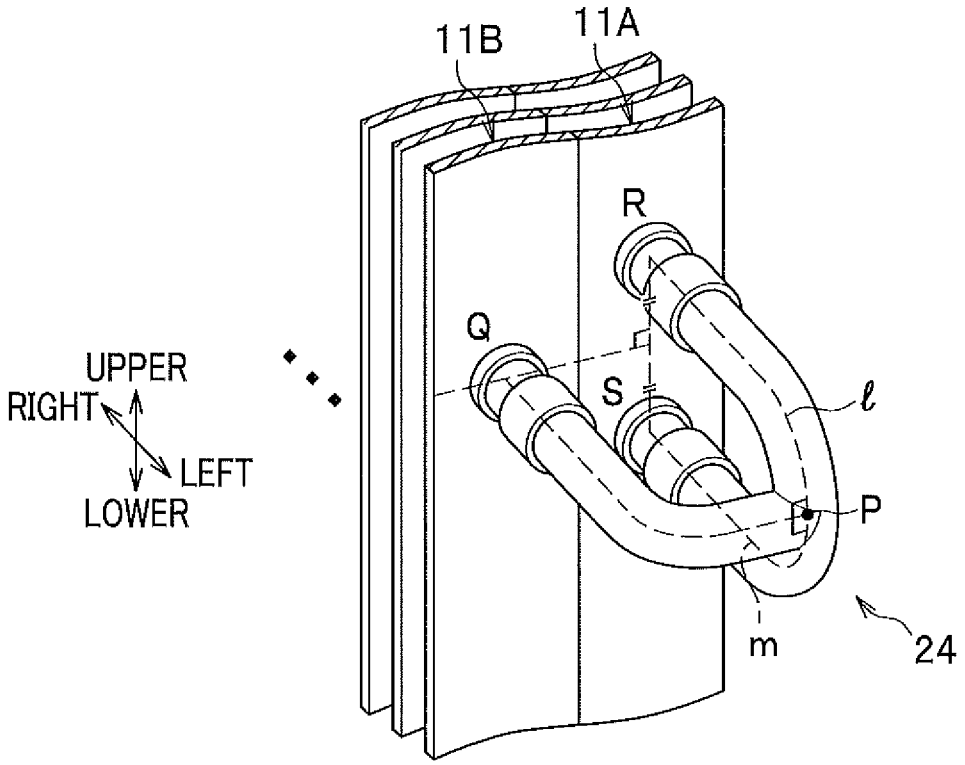
FIG. 4 is an enlarged perspective view of a branching and merging part in the heat exchanger according to the first embodiment.

Next, FIG. 4 is an enlarged perspective view of the branching and merging part 24*a*~24*c* (generically named by reference sign 24) in the heat exchanger 3A according to the first embodiment.

As shown in FIG. 4, the three-forked shape of the branching and merging part 24*a*~24*c* in the heat exchanger 3A has a shape such that distances (flow path lengths) l, m, which are taken from when the refrigerant flows into the fin plate 11A (defined as points R, S) until reaching the branching and merging part 24*a*~24*c* (defined as a merging point P), are equal to each other (l=m).

Moreover, the three-forked shape of the branching and merging part 24*a*~24*c* in the heat exchanger 3A has a shape such that the refrigerant is merged and discharged at the merging point P in a direction orthogonal to both of the flow paths RP and SP.

Furthermore, in the three-forked shape of the branching and merging part 24*a*~24*c* in the heat exchanger 3A, a height position in the vertical direction of a point Q, at which the refrigerant flows into the fin plate 11B, is set to be equal to a height of an intermediate position of a line segment connecting between the points R and S.

This allows the refrigerant to be equally distributed and merged at the merging point P of the branching and merging part 24*a*~24*c*, thus making it possible to prevent generation of deflected flow. Moreover, the three-forked part of the branching and merging part 24*a*~24*c* can be formed using materials having a small number of bend sections and easy to be machined. Consequently, an increase in production cost of the branching and merging part 24*a*~24*c* can be prevented.

Operation and Effects

The heat exchanger 3A according to the first embodiment of the present invention is provided with the plurality of rows of fin plates 11A, 11B. Here, the refrigerant path is defined as a refrigerant flow path (communicating path) that communicates each row of fin plates 11A, 11B with each other. Moreover, the heat exchanger 3A includes in the vertical direction, at least four refrigerant paths 20*a*~23*a* into which the refrigerant flows during use as a condenser, and out of which the refrigerant flows during use as an evaporator.

Furthermore, in the case where the heat exchanger 3A functions, e.g., as a condenser, it is provided with the branching and merging parts 24*a*~24*c* so as to allow the number of paths to be decreased when the refrigerant flows out of one heat exchange part region of at least four sectioned heat exchange part regions HE1*a*~HE2*b* in the heat exchanger 3A into the other heat exchange part region.

When thus configured, the path arrangement can be set to irregularly and gradually decrease the number of paths when the heat exchanger 3A functions as a condenser. Therefore, in the domain in which the gas phase refrigerant is dominant, the number of paths can be increased to decrease the flow velocity and thus increase in the pressure loss can be prevented.

Moreover, in the domain in which the liquid phase refrigerant is dominant, the number of paths can be decreased to increase the flow velocity and thus improvement in the heat transfer coefficient can be achieved.

Further, when the heat exchanger 3A functions as an evaporator, the number of paths at the outlet side during use as an evaporator (the inlet side during use as the condenser) can be increased at least by a factor of four, as compared to the number of paths at the inlet side during use as the evaporator (the outlet side during use as the condenser). This makes it possible to prevent the pressure loss from being increased in the domain in which the gas phase refrigerant is dominant.

Moreover, the heat exchanger 3A according to the present embodiment allows the connection pipes 35*a*, 35*b* to be connected diagonally in the vertical direction so as to connect the upper heat exchange part region HE1 and the lower heat exchange part region HE2 to each other. Consequently, the branching and merging parts 24*a*~24*c* can be arranged at appropriate positions in the upper heat exchange part region HE1 and the lower heat exchange part region HE2, respectively.

This makes it possible to decrease the required number of rows of fin plates 11A, 11B, . . . in the heat exchanger 3A and thus to realize space-saving of an installation space of the heat exchanger 3A.

Moreover, the heat exchanger 3A allows "the length in the vertical direction of the first upper heat exchange part region HE1*a* to be longer than (>) the length in the vertical direction of the second lower heat exchange part region HE2*b*".

This makes it possible to easily increase, to four or more, the number of paths in the domain in which the gas phase refrigerant flowing into the branching and merging parts 24*a*, 24*b* in the first round is dominant, concretely, the number of heat transfer pipes 20*a*~23*a*. When thus arranged, the pressure loss can be decreased to enhance the heat exchanging efficiency in the case where the heat exchanger 3A functions especially as an evaporator.

Moreover, the heat exchange part region HE1*a* nearest the gas-side port (gate 40) in the heat exchanger 3A is provided above the heat exchange part region HE2*b* nearest the liquid-side port (gate 41).

That is, the first upper heat exchange part region HE1*a* allowing the gas phase refrigerant to be dominant is provided above the second lower heat exchange part region HE2*b* allowing the liquid phase refrigerant to be dominant.

Arranging in this way causes the liquid phase refrigerant to be easy to accumulate, particularly under the influence of gravity, in the second lower heat exchange part region HE2*b* provided below the first upper heat exchange part region HE1*a*. That is, the gas phase refrigerant can be easily accumulated in the first upper heat exchange part region HE1*a*, and the liquid phase refrigerant can be easily accumulated in the second lower heat exchange part region HE2*b*. This makes it possible to enhance the heat exchanging efficiency.

Second Embodiment

Figure 5:
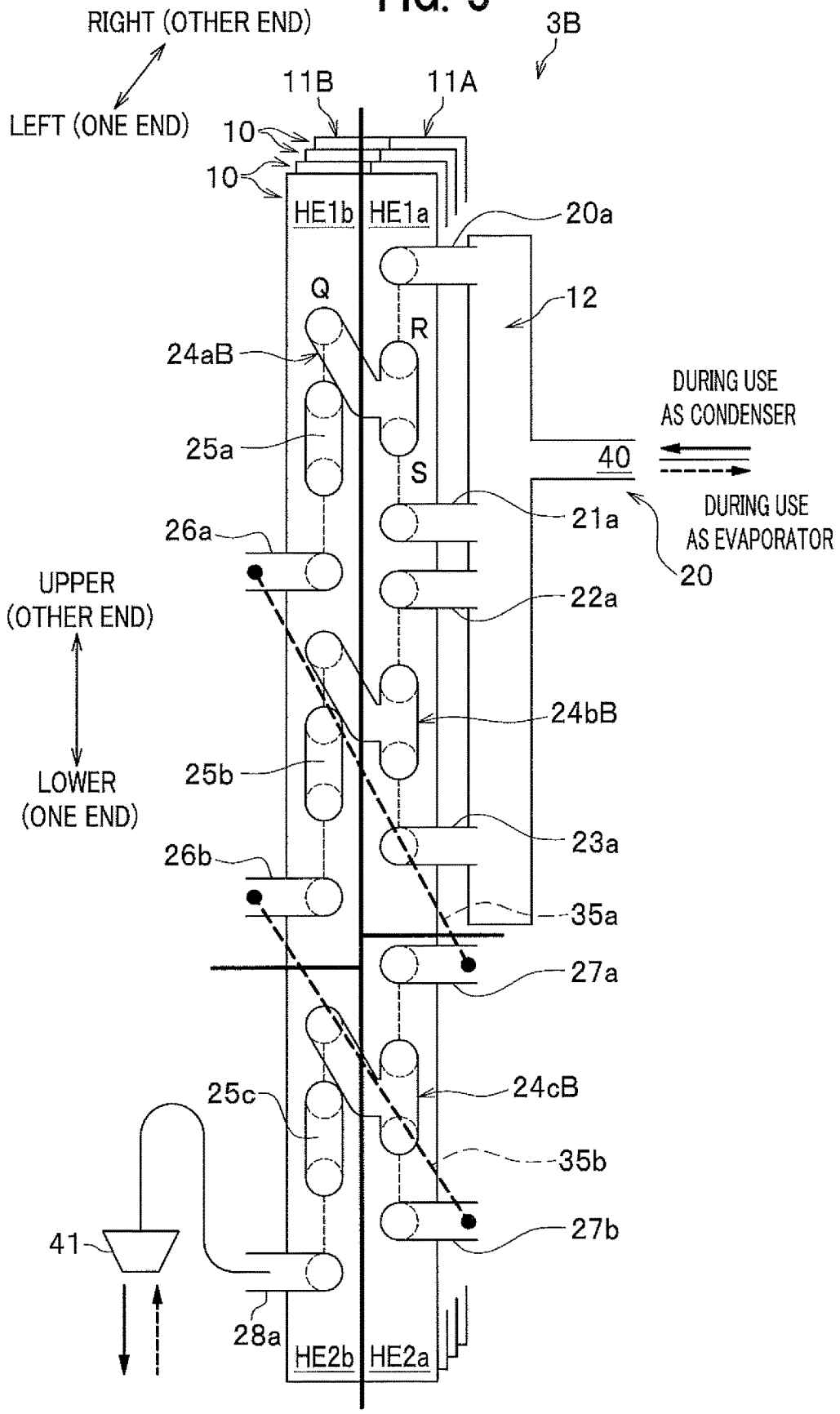
FIG. 5 is a schematic diagram for explaining a state of refrigerant paths in a heat exchanger according to a second embodiment.
Figure 6:
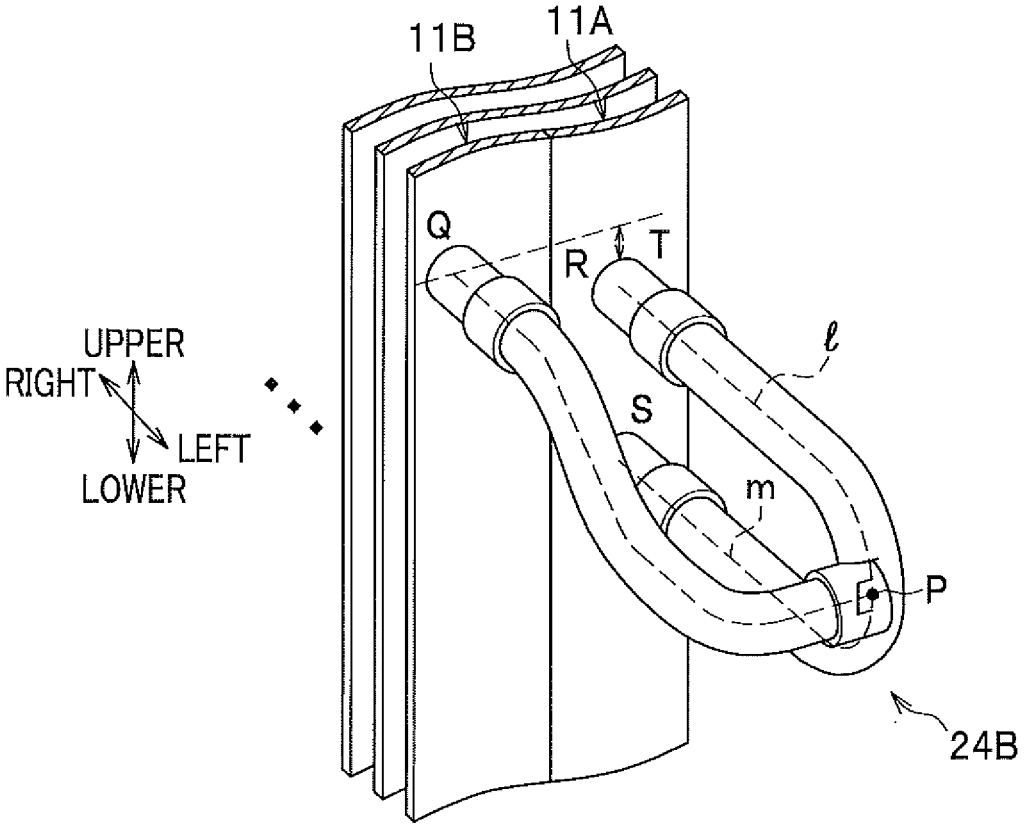
FIG. 6 is an enlarged perspective view of a branching and merging part in the heat exchanger according to the second embodiment.

FIG. 5 is a schematic diagram for explaining a state of refrigerant paths in a heat exchanger 3B according to a second embodiment. FIG. 6 is an enlarged perspective view of a branching and merging part in the heat exchanger 3B according to the second embodiment.

Hereinafter, the heat exchanger 3B according to the second embodiment will be described with alternate reference to FIG. 5 and FIG. 6. Note that FIG. 5 is a diagram corresponding to FIG. 3 showing the first embodiment. Moreover, the same constituent element as in the first embodiment is given the same reference sign and thus repetitive description thereof is omitted.

The heat exchanger 3A in the first embodiment allows, in the three-forked shape of the branching and merging part 24*a*~24*c* (generically named by reference sign 24), the height position in the vertical direction of the point Q, at which the refrigerant flows into the fin plate 11B, to be set to be equal to the height of the intermediate position of the line segment connecting between the points R and S (see FIG. 4).

In contrast, as shown in FIG. 5 and FIG. 6 (particularly, see FIG. 6), the heat exchanger 3B in the second embodiment has differences described below, compared with the heat exchanger 3A in the first embodiment. More specifically, in the three-forked shape of a branching and merging part 24*a*B~24*c*B (generically named by reference sign 24B), the height position in the vertical direction of the point Q, at which the refrigerant flows into the fin plate 11B, is set to be higher, e.g., by a distance T, than the height position in the vertical direction of the point R. That is, the heat transfer pipe composing a path flow between the points P and Q is formed to be twisted and bent upward halfway on the path flow.

Configurations other than this, for example, the shape such that the flow path lengths l, m are equal to each other (l=m), and the shape such that the refrigerant is merged and discharged at the merging point P in a direction orthogonal to both of the flow paths RP and SP, are the same as those in the first embodiment.

Even when thus configured, the same effects as those in the first embodiment can be caused. When such branching and merging parts 24*a*B~24*c*B are used, the branching and merging parts 24*a*B~24*c*B can be located, for example, as shown in FIG. 5, even if a hole at the point Q is formed with a point thereof being displaced upward in order to avoid the heat transfer pipes 25*a*~25*c* in the fin plate 11B, thus being preferable.

Note that, although description has been given of the example in which the hole at the point Q is formed with the point thereof being displaced upward, the hole at the point Q is not particularly limited to this example, but may be formed with the point thereof being displaced downward. Moreover, a length of the distance T (see FIG. 6) is not particularly limited, either.

Note that the heat exchanger 3B according to the present embodiment can also be restated in the same manner as in the first embodiment, as follows. That is, the heat exchanger 3B is the heat exchanger 3, 7 of fin-plate type 11A, 11B, . . . used in the outdoor unit 100A, or the indoor unit 100B, of the air conditioner 100. The heat exchanger 3B includes the gas-side port (gate 40) connected to the piping through which the gaseous refrigerant flows, the liquid-side port (gate 41) connected to the piping through which the liquid refrigerant flows, and the refrigerant path that links the gas-side port to the liquid-side port. The heat exchanger 3B further includes at least four heat exchange part regions HE1*a*~HE2*b* that perform heat exchange between air and the refrigerant flowing through the refrigerant path, and the branching and merging part 24B (24*a*B~24*c*B) that branches and merges the refrigerant path to connect the heat exchange part regions HE1*a*~HE2*b* in series between the gas-side port (gate 40) and the liquid-side port (gate 41) through the refrigerant path.

Moreover, the heat exchange part regions HE1*a*~HE2*b* are connected to each other through the branching and merging part 24B (24*a*B~24*c*B) so as to allow the number of refrigerant paths (heat transfer pipes 20*a*~23*a*) provided in the heat exchange part region HE1*a* nearest the gas-side port (gate 40) to be greater than the number of refrigerant paths (heat transfer pipe 28*a*) provided in the heat exchange part region HE2*b* nearest the liquid-side port (gate 41).

Moreover, the heat exchange part region HE1*a* nearest the gas-side port (gate 40) is provided above the heat exchange part region HE2*b* nearest the liquid-side port (gate 41).

Third Embodiment

Figure 7:
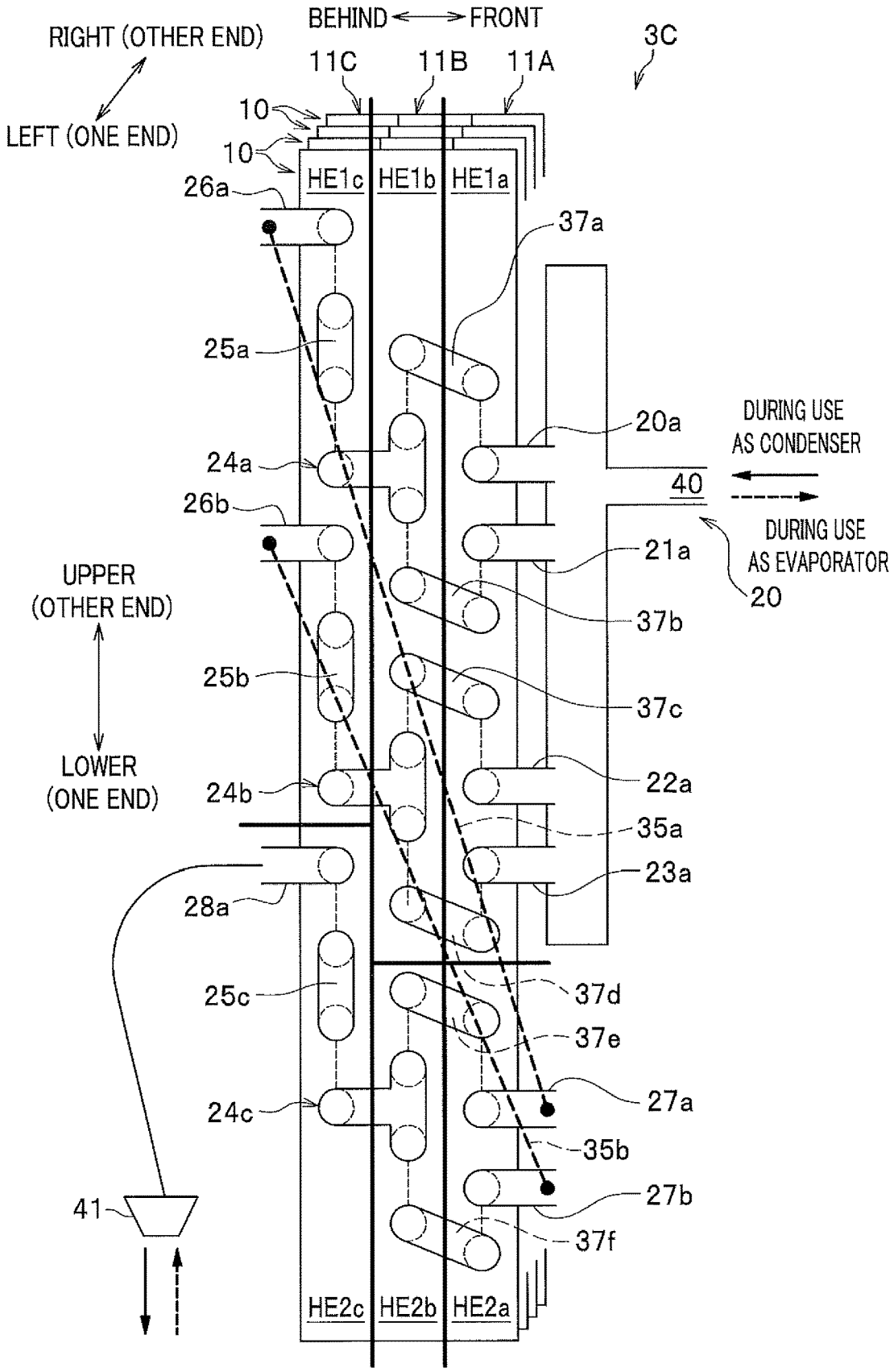
FIG. 7 is a schematic diagram for explaining a state of refrigerant paths in a heat exchanger according to a third embodiment.

FIG. 7 is a schematic diagram for explaining a state of refrigerant paths in a heat exchanger 3C according to a third embodiment. Note that FIG. 7 is a diagram corresponding to FIG. 3 showing the first embodiment. Moreover, the same constituent element as in the first embodiment is given the same reference sign and thus repetitive description thereof is omitted.

As for the heat exchanger 3A in the first embodiment, description is given of the case in which it is provided with two rows of fin plates 11A, 11B. However, the number of rows of fin plates is not limited to two. The heat exchanger 3C according to the third embodiment is different from that in the first embodiment in that it is provided with three rows of fin plates 11A, 11B, 11C.

Note that, with arrangement of the fin plates in three rows, heat transfer pipes 37*a*~37*f* (and return bends associated therewith) composing refrigerant paths are arranged, for example, at boundaries between the fin plates 11A, 11B (compare and contrast FIG. 7 with FIG. 3). Configurations other than this are the same as those in the first embodiment.

Note that, in this case, the upper heat exchange part region HE1 is a region that includes the first upper heat exchange part region HE1*a*, the second upper heat exchange part region HE1*b*, and a third upper heat exchange part region HE1*c*. Here, the first upper heat exchange part region HE1*a* and the second upper heat exchange part region HE1*b* are, in the fin plates 11A, 11B, regions on the upper side including the heat transfer pipe 37*d*. Moreover, the third upper heat exchange part region HE1*c* is, in the fin plate 11C, a region on the upper side including the branching and merging part 24*b*.

Moreover, the lower heat exchange part region HE2 is a region that includes the first lower heat exchange part region HE2*a*, the second lower heat exchange part region HE2*b*, and a third lower heat exchange part region HE2*c*. Here, the first lower heat exchange part region HE2*a* and the second lower heat exchange part region HE2*b* are, in the fin plates 11A, 11B, regions on the lower side than the heat transfer pipe 37*d*. Moreover, the third lower heat exchange part region HE2*c* is, in the fin plate 11C, a region on the lower side than the branching and merging part 24*b*.

Furthermore, when the number of refrigerant paths is counted in the present embodiment, in the same manner as in the first embodiment, the number of the heat transfer pipes 20*a*~23*a*, the branching and merging parts 24*a*~24*c*, the connection pipes 35*a*, 35*b*, or the heat transfer pipes 37*a*~37*f* should be counted.

Here, places at which the heat transfer pipes 37*a*~37*f* composing the refrigerant paths are arranged are not particularly limited to the boundaries between the fin plates 11A, 11B, and configuration may be adopted such that the heat transfer pipes 37*a*~37*f* are arranged at boundaries between the fin plates 11B, 11C. In this case, the branching and merging parts 24*a*~24*c* should be arranged at the boundaries between the fin plates 11A, 11B. That is, the heat transfer pipes 37*a*~37*f* and the branching and merging parts 24*a*~24*c* can be exchanged in the order of arrangement in a thickness direction in front of and behind the heat exchanger 3C (in the right-left direction of the paper in FIG. 7).

Even when thus configured, the same effects as those in the first embodiment can be caused. That is, in the same manner as in the first embodiment, the heat exchanger 3C according to the third embodiment allows the branching and merging parts 24*a*~24*c* to be provided once in the upper heat exchange part region HE1 (branching and merging parts 24*a*, 24*b*) and once in the lower heat exchange part region HE2 (branching and merging part 24*c*). In other words, the heat exchanger 3C allows the branching and merging parts 24*a*~24*c* to be provided twice in total between the fin plates 11A and 11B, or between the fin plates 11B and 11C.

Moreover, when the branching and merging parts 24*a*~24*c* are provided, for example, at boundaries between the fin plates 11A, 11B, the number of paths can be changed and increased in a domain in which the gas phase refrigerant is dominant on the side near the gate 40, as compared to a known heat exchanger of three-row type, for example, described in Patent Literature 2. Note that the heat exchanger described in Patent Literature 2 makes it impossible to change the number of paths so long as the number of rows of the fin plates is not increased (see the heat exchanger shown in FIG. 1 in Patent Literature 2).

Incidentally, the case where the branching and merging parts 24*a*~24*c* are provided at boundaries between the fin plates 11A, 11B exhibits path arrangement which makes much account of a decrease in pressure loss in the heat exchanger 3C during heating operation. That is, the heat exchanger 3C thus configured makes it possible to realize specifications suitable for use exclusive for heating operation, as compared to the known heat exchanger of three-row type described in Patent Literature 2.

While on the other hand, as shown in FIG. 7, when the branching and merging parts 24*a*~24*c* are provided at boundaries between the fin plates 11B, 11C, the number of paths can be decreased in a domain in which the liquid phase refrigerant is dominant on the side near the gate 41, as compared to the known heat exchanger, e.g., described in Patent Literature 2. Note that the heat exchanger described in Patent Literature 2 makes it impossible to change the number of paths as described above.

Incidentally, the case of FIG. 7 of the present embodiment exhibits path arrangement which makes much account of an increase in the flow velocity and achievement of improvement in the heat transfer coefficient in the heat exchanger 3C during cooling operation. That is, the heat exchanger 3C thus configured makes it possible to realize specifications suitable for use exclusive for cooling operation, as compared to the known heat exchanger of three-row type described in Patent Literature 2.

Note that the heat exchanger 3C according to the present embodiment can also be restated in the same manner as in the first embodiment, as follows. That is, the heat exchanger 3C is the heat exchanger 3, 7 of fin-plate type 11A, 11B, . . . used in the outdoor unit 100A, or the indoor unit 100B, of the air conditioner 100. The heat exchanger 3C includes the gas-side port (gate 40) connected to the piping through which the gaseous refrigerant flows, the liquid-side port (gate 41) connected to the piping through which the liquid refrigerant flows, and the refrigerant path that links the gas-side port to the liquid-side port. The heat exchanger 3C further includes at least four heat exchange part regions HE1*a*~HE2*c* that perform heat exchange between air and the refrigerant flowing through the refrigerant path, and the branching and merging part 24 (24*a*~24*c*) that branches and merges the refrigerant path to connect the heat exchange part regions HE1*a*~HE2*c* in series between the gas-side port (gate 40) and the liquid-side port (gate 41) through the refrigerant path.

Moreover, the heat exchange part regions HE1*a*~HE2*c* are connected to each other through the branching and merging part 24 so as to allow the number of refrigerant paths (heat transfer pipes 20*a*~23*a*) provided in the heat exchange part region HE1*a* nearest the gas-side port (gate 40) to be greater than the number of refrigerant paths (heat transfer pipe 28*a*) provided in the heat exchange part region HE2*c* nearest the liquid-side port (gate 41).

Moreover, the heat exchange part region HE1*a* nearest the gas-side port (gate 40) is provided above the heat exchange part region HE2*c* nearest the liquid-side port (gate 41).

Furthermore, the heat exchanger 3C has a flow path passing through the branching and merging parts 24*a*~24*c* and a flow path not passing through the branching and merging parts 24*a*~24*c* when the refrigerant flows out of one of the heat exchange part regions HE1*a*~HE2*c* into another of the heat exchange part regions HE1*a*~HE2*c*. Note that the flow path not passing through the branching and merging parts 24*a*~24*c* means, specifically, a flow path passing through the connection pipes 35*a*, 35*b* and the heat transfer pipes 37*a*~37*f*.

The first embodiment, the second embodiment and the third embodiment described above have been described in detail for explaining the content of the present invention in a plain way, and are not necessarily limited to what is provided with all of the configurations described above.

Also, part of the configuration of one embodiment can be replaced with the configuration of the other embodiment, and part or all of the configuration of one embodiment can also be added to the configuration of the other embodiment.

Moreover, for part of the configuration of each embodiment, the configuration of the other embodiment can also be added to, deleted from, or replaced for.

For example, although description is given of the example in which the branching and merging parts 24 in the heat exchanger 3A, 3B, 3C according to each embodiment of the present invention are three-forked, the branching and merging parts are not particularly limited to this example.

Figure 8:
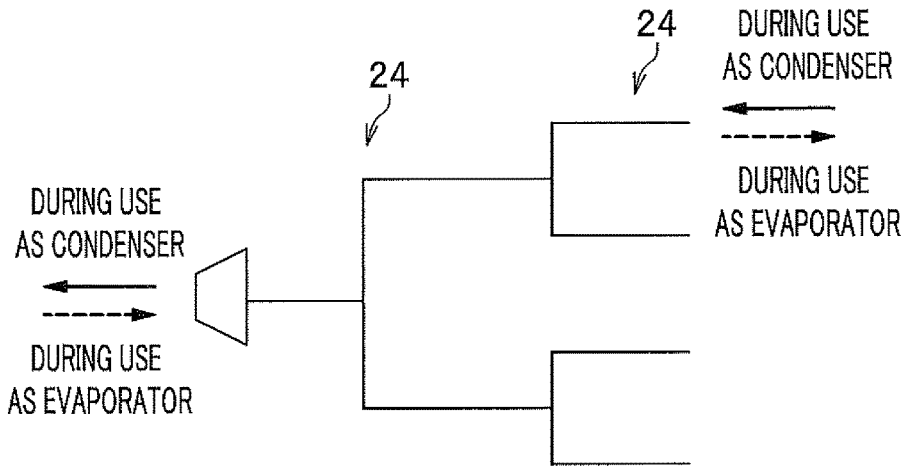
FIG. 8 is a diagram schematically showing refrigerant flow paths in the heat exchanger according to the first embodiment and the second embodiment.

FIG. 8 is a diagram schematically showing refrigerant flow paths in the heat exchanger according to the first embodiment to the third embodiment. Note that, in FIG. 8, and in FIG. 9 to be described below, places other than the branching and merging parts 24, where flow paths are bent, are all indicated by a straight line.

In each embodiment of the present invention as described above, the branching and merging parts 24 in the heat exchanger are all three-forked. Therefore, when the refrigerant flow paths in the heat exchanger according to each embodiment of the present invention are schematically depicted, they exhibit a shape such as shown in FIG. 8 in all of the embodiments. However, the refrigerant flow paths are not particularly limited to this shape.

Figure 9:
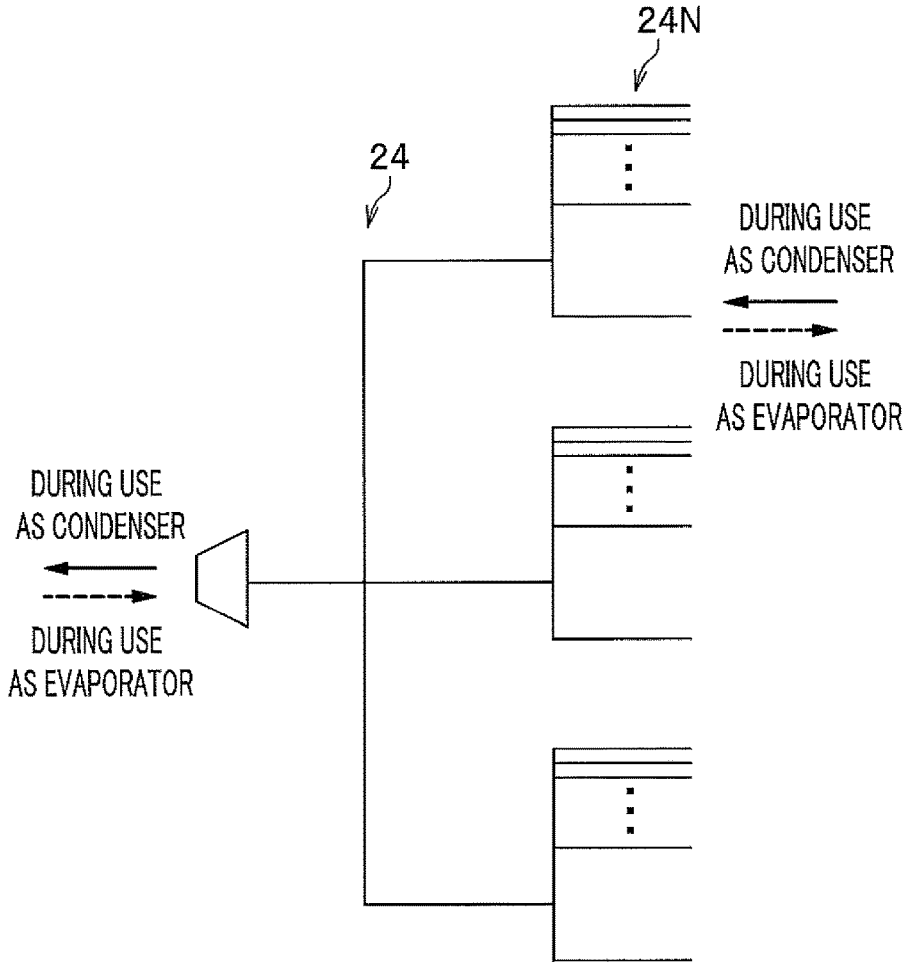
FIG. 9 is a diagram schematically showing refrigerant flow paths in a heat exchanger according to a modified example.

FIG. 9 is a diagram schematically showing refrigerant flow paths in a heat exchanger according to a modified example.

As shown in FIG. 9, for example, the branching and merging part 24 may be what has an N-forked shape, i.e., an N-forked branching and merging part 24N.

Furthermore, the heat exchanger 3 according to each of the embodiments of the present invention may be configured to allow the schematic diagram of refrigerant flow paths to exhibit a nearly pyramidal shape in which a plurality of branching and merging parts 24N are cascade-connected with each other. That is, the schematic diagram of refrigerant flow paths may exhibit a shape in which the N-forked branching and merging parts 24N are arranged stepwise in N stages. Note that in FIG. 9, the N-forked branching and merging parts 24N are used in the first stage, and the three-forked branching and merging part 24 (any one of the branching and merging parts 24*a*~24*c*, 24*a*B~24*c*B) is used in the second stage. That is, FIG. 9 illustrates the case of two-stage shape.

Moreover, although in the third embodiment, description is given of the case in which the branching and merging parts 24*a*~24*c* are employed, the branching and merging parts 24*a*B~24*c*B in the second embodiment can also be employed in place of the branching and merging parts 24*a*~24*c*.

Furthermore, in the third embodiment, description is given of the modified example in which the branching and merging parts 24*a*~24*c* in both of the upper heat exchange part region HE1 and the lower heat exchange part region HE2 are transferred to boundaries between the fin plates 11A, 11B.

However, configuration may be adopted such that the branching and merging parts 24*a*, 24*b* in the upper heat exchange part region HE1, or only the branching and merging part 24*c* in the lower heat exchange part region HE2 are/is transferred to boundaries between the fin plates 11A, 11B.

That is, the branching and merging parts 24*a*~24*c* may be arranged diagonally through the connection pipes 35*a*, 35*b* between different fin plates 11A, 11B, . . . .

REFERENCE SIGNS LIST

1 Compressor
2 Four-way valve
3, 7, 3A, 3B, 3C Heat exchanger
4, 8 Blower
5, 6 Expansion valve
10 Fin
11A~11C Fin plate
12 Header
20 Refrigerant piping
20*a*, 21*a*, 22*a*, 23*a*, 25*a*~25*c*, 26*a*~26*b*, 27*a*~27*b*, 28*a*, 37*a*~37*f* Heat transfer pipe
24, 24B, 24N, 24*a*~24*c*, 24*a*B~24*c*B Branching and merging part
31*a*~31*d*, 32*a*~32*d*, 33*a*~33*d* Return bend
35*a*, 35*b* Connection pipe
40, 41 Gate
100 Air conditioner
100A Outdoor machine (Outdoor unit)
100B Indoor machine (Indoor unit)
HE1 Upper heat exchange part region
HE1*a* First upper heat exchange part region
HE1*b* Second upper heat exchange part region
HE1*c* Third upper heat exchange part region
HE2 lower heat exchange part region
HE2*a* First lower heat exchange part region
HE2*b* Second lower heat exchange part region
HE2*c* Third lower heat exchange part region
P, Q, R, S Point
T Distance
l, m Flow path length

The invention claimed is:

1. A heat exchanger of fin-plate type used in a cooling and heating device provided with a refrigerating cycle, comprising:

a gas-side port connected to a header and connected to piping through which a gaseous refrigerant flows;

a liquid-side port connected to piping through which a liquid refrigerant flows;

a refrigerant path, including a plurality of pipes, that links the gas-side port to the liquid-side port;

at least four heat exchange regions that perform heat exchange between air and the refrigerant flowing through the refrigerant path; and a plurality of branching and merging parts that branch and merge the refrigerant path to connect the heat exchange regions in series between the gas-side port and the liquid-side port through the refrigerant path, wherein the heat exchange regions are connected to each other through the branching and merging parts such that a number of pipes disposed in a first heat exchange region is greater than a number of pipes disposed in a fourth heat exchange region, wherein each of the pipes connected to the header enters the heat exchanger within the first region, wherein each of the pipes in a third region in the series of heat exchange regions are disposed below each of the pipes in the first region, in a vertical direction and wherein the refrigerant that flows into and out of the heat exchanger through the refrigerant path flows through the respective pipes of each of the at least four heat exchange regions in order according to the series.

2. The heat exchanger according to claim 1, wherein the first heat exchange region is disposed above the fourth heat exchange region in the vertical direction.

3. The heat exchanger according to claim 1, wherein the heat exchanger has a flow path passing through the plurality of branching and merging parts and a flow path not passing through the branching and merging part when the refrigerant flows out of one heat exchange region into another heat exchange region.

4. The heat exchanger according to claim 1, wherein the heat exchange regions are grouped into at least an upper heat exchange region and a lower heat exchange region, and a length in the vertical direction of the upper heat exchange region is longer than a length in the vertical direction of the lower heat exchange region.

5. The heat exchanger according to claim 4, wherein the heat exchanger is configured to allow the refrigerant to flow in through one heat exchange region in the upper heat exchange region, then flow through another adjacent heat exchange region in the upper heat exchange region, then flow through a connection pipe into one heat exchange region in the lower heat exchange region, then flow through another adjacent heat exchange region in the lower heat exchange region, and flow out.

6. The heat exchanger according to claim 1, wherein two rows of fin plates or three rows of fin plates are provided, and each branching and merging part includes a part having a three prongs.

7. A heat exchanger used in a cooling and heating device provided with a refrigerating cycle, the heat exchanger comprising:

a header;

a plurality of rows of fin plates; and when a refrigerant flow path, including a plurality of pipes, communicating each row of fin plates with each other is defined as a refrigerant path, at least four refrigerant paths provided in a vertical direction, into which refrigerant flows during use as a condenser, and out of which the refrigerant flows during use as an evaporator;

a plurality of branching and merging parts that branch and merge the refrigerant path to connect the heat exchange regions in series between the gas-side port and the liquid-side port through the refrigerant path, wherein the plurality of rows of fin plates include at least four heat exchange regions, wherein in a case where the heat exchanger functions as a condenser, the branching and merging parts are disposed such that a number of pipes decreases when the refrigerant flows out of a first heat exchange region into a fourth heat exchange region among the heat exchange regions, wherein each of the pipes connected to the header enters the heat exchanger within the first region, wherein each of the pipes in a third region in the series of heat exchange regions are disposed below each of the pipes in the first region, in a vertical direction and wherein the refrigerant that flows into and out of the heat exchanger through the refrigerant path flows through the respective pipes of each of the at least four heat exchange regions in order according to the series.

* * * * *